United States Patent [19]

Hattori et al.

[11] Patent Number: 4,811,986

[45] Date of Patent: Mar. 14, 1989

[54] ADJUSTABLE LUMBAR SUPPORT

[75] Inventors: Takemi Hattori, Kariya; Hirofumi Kume, Toyota, both of Japan

[73] Assignee: Aisin Seiki Kabushiki Kaisha, Japan

[21] Appl. No.: 585,185

[22] Filed: Mar. 1, 1984

[30] Foreign Application Priority Data

Mar. 3, 1983 [JP] Japan ..... 58-30636

[51] Int. Cl.[4] ..... A47C 7/46

[52] U.S. Cl. ..... 297/284

[58] Field of Search ..... 297/284, 458, 460; 74/141, 140, 138; 248/188.2, 157, 180

[56] References Cited

U.S. PATENT DOCUMENTS

| | | | |
|---|---|---|---|
| 184,264 | 11/1876 | Rice | 74/141 |
| 847,229 | 3/1907 | Branam | 74/141 |
| 947,570 | 1/1910 | Carson et al. | 74/141 |
| 1,789,617 | 1/1931 | Brennan | 74/141 |
| 3,018,992 | 1/1962 | Love | 248/180 |
| 3,026,159 | 3/1962 | Miller et al. | 108/1 |
| 3,890,000 | 6/1975 | Easley | 297/284 |
| 4,162,807 | 7/1979 | Yoshimova | 297/284 |
| 4,182,533 | 1/1980 | Arndt et al. . | |
| 4,295,681 | 10/1981 | Gregory | 297/284 |
| 4,296,965 | 10/1981 | Sakurada et al. . | |
| 4,449,751 | 5/1984 | Murphy et al. | 297/284 |
| 4,576,410 | 3/1986 | Hattori | 267/284 |

*Primary Examiner*—Kenneth J. Dorner
*Assistant Examiner*—Mark W. Binder
*Attorney, Agent, or Firm*—Fennegan, Henderson, Farabow, Garrett & Dunner

[57] ABSTRACT

A lumbar support structure of the present invention includes a cam means rotatably supported on bracket to which one end of torsion spring is pivoted. The cam means is actuated by a lever on the side of the seatback to vertically move the lumbar support through cable member connecting the two. The lumbar support structure further includes a cam member pivoted to the bracket and movable in response to caming action of the cam means, and the support plate which is adjustably rotated upon the movement of cam member so that the support plate may be vertically movable to change the contact position with the seatback.

1 Claim, 5 Drawing Sheets

ADJUSTABLE LUMBAR SUPPORT

BACKGROUND OF THE INVENTION

1. Field of the Invention

This invention relates generally to a lumbar support, and more particularly to an adjustable lumbar support installed in a seatback of a vehicle seat.

2. Description of the Prior Art

A lumbar support installed in a vehicle seatback is used for changing or adjusting the firmness of seat spring in the seatback in order to reduce the back fatigue of an occupant who sits on the seat of a vehicle for a long time without standing or moving therefrom. The adjustment of the lumbar support usually is carried out by turning a lever or a knob provided at a side portion of a seat (such as a lever 14 or 16 shown in FIG. 1). When the lever is rotated, a cam member, provided within the seatback and operatively connected to the lever, is rotated to move a support plate in a horizontal direction (usually in a vehicle longitudinal direction). This movement of the support plate permits regulation of the degree of pressure or the hardness of the cushion of the seatback designed to be aligned with the lumbar region of the occupant of the seat.

Such conventional lumbar support, however, has ignored the hight differences in the lumbar position of users of such seatback. Without the capacity of adjusting the height of a lumbar support for a seatback, the most appropriate and comfortable lumbar support for each individual cannot be obtained.

SUMMARY OF THE INVENTION

Accordingly, it is an object of the present invention to provide an improved lumbar support which can be vertically adjustable according to the height of the lumbar region of each user.

It is another object of the invention to provide an improved lumbar support for a seatback which can be adjustable both in horizontal and vertical directions according to the requirements of the user.

Additional objects and advantages of the invention will be set forth in the description which follows, and in part will be obvious from the description, or may be learned by the practice of the invention. The objects and advantages of the invention may be realized and obtained by means of the structure and structural cooperation particularly pointed out in the appended claims.

To achieve the foregoing objects, and in accordance with the invention as embodied and broadly described herein, a lumbar support structure of the present invention includes a cam means rotatably supported on bracket to which one end of torsion spring is pivoted. The cam means is actuated by a lever on the side of the seatback to vertically move the lumbar support through a cable member connecting the two. The lumbar support structure further includes a cam member pivoted to the bracket and movable in response to caming action of the cam means, and the support plate which is adjustably rotated upon the movement of cam member so that the support plate may be vertically movable to change the contact position with the seatback. The structure further includes a pair of shafts separately disposed in the seatback, one being connected to the cam means which is engaged with the torsion spring for horizontal movement and the other being connected to an adjusting plate for vertical movement. Each shaft is connected to each lever which is provided preferably on separated portion of seatback.

The cam means, preferably, is rotatable in accordance with the rotation of the lever via a cable. When the lever is rotated to pull the cable, a release plate is rotated overcoming a spring force thereby to actuate the cam means. The release plate then becomes in snap engagement with a cam follower. The cam follower moves to change the vertical angular position of support plate having a plurality of surfaces. The number of surfaces of the support plate corresponds to the number of steps of the vertical adjustment positions. The cam member may be rotated about an axis vertical to the support plate surfaces or an axis parallel to the plate surfaces. As has been explained, the adjustment of the lumbar support is carried out by a first drive force for moving the support plate in horizontal and longitudinal direction of a vehicle and a second drive force for moving the support plate in vertical direction. Each drive force is transmitted from each shaft connected to respective levers provided on each side portion of the seatback. An inner end of one shaft is connected with the cam member for actuating the torsion spring and the inner end of the other shaft is connected with a release plate for pulling the cable. According to the present invention, the lumbar support is provided with a front and rearward direction adjustment for the pressure force against the lumbar region of a seated occupant, as well as with a vertical direction adjustment for changing the height of the lumbar region of the person so that the seated occupant may comfortably chose the position of the lumbar support according to his or her preference.

Further, the lumbar support according to the present invention has been completed without altering the external shape of the conventional support nor modifying the conventional seatback.

BRIEF DESCRIPTION OF THE DRAWINGS

Various features, objects, and advantages of the present invention will be described in connection with the accompanying drawings in which.

DESCRIPTION OF THE PREFERRED EMBODIMENT

Figure 1:
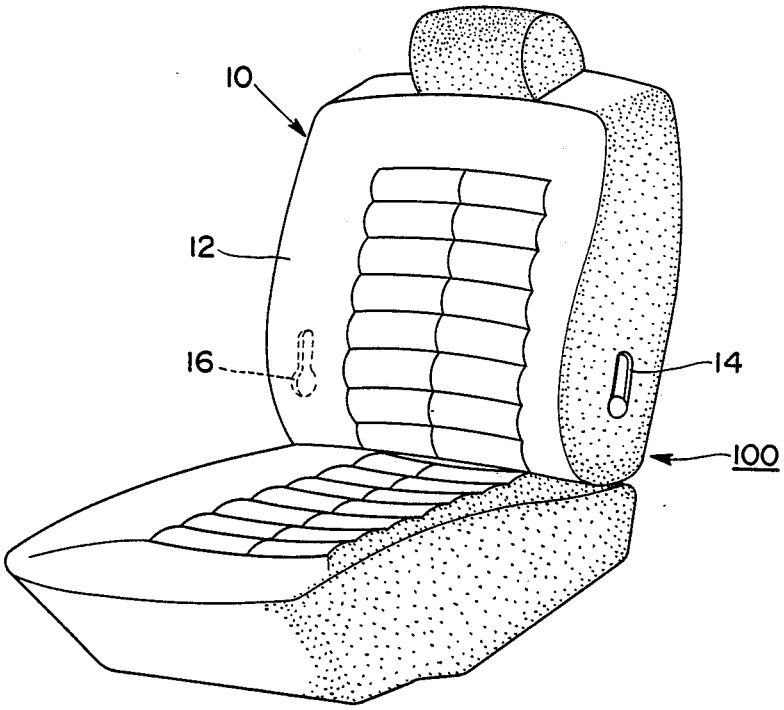
FIG. 1 is a perspective view of a seat having seatback and lumbar support of the present invention.
Figure 2:
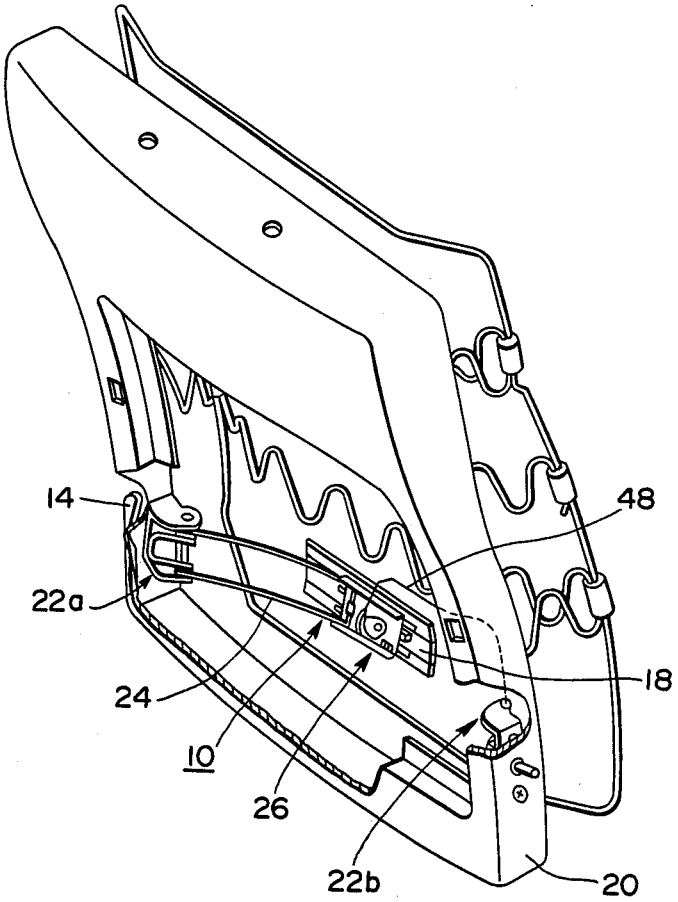
FIG. 2 is a perspective view of the seatback of FIG. 1.

Referring to FIGS. 1 and 2 together, a lumbar support 10 of the present invention is confined in a seatback 12 of seat assembly 100. The levers 14 and 16 shown in FIG. 1 are operatively connected to the lumbar support 10. The lumbar support 10 affords an occupant of the seat 100 optimum comfort by permitting adjustment of lumbar support 10 through use of the levers 14 and 16 mounted on lateral surfaces of seatback 12. This is accomplished according to the present invention by providing for movement of lumbar support 10 in a horizontal direction as well as by enabling the effective point of contact between lumbar support 10 and the back of lumbar region to be varied in the vertical direction.

The lumbar support 10 includes a first bracket 22*a* secured to a first lateral side of frame 20 of the seatback, a torsion spring 24 pivotally mounted on the first bracket 22*a* at one end thereof, a support plate bracket assembly 26 connected to the other end of the torsion spring 24, a support plate 18 mounted on the support plate bracket assembly 26, a second bracket 22*b* secured to a second lateral side of frame 20 and a cable member 48 connecting the second bracket 22*b* with the support plate bracket assembly 26.

Figure 3:
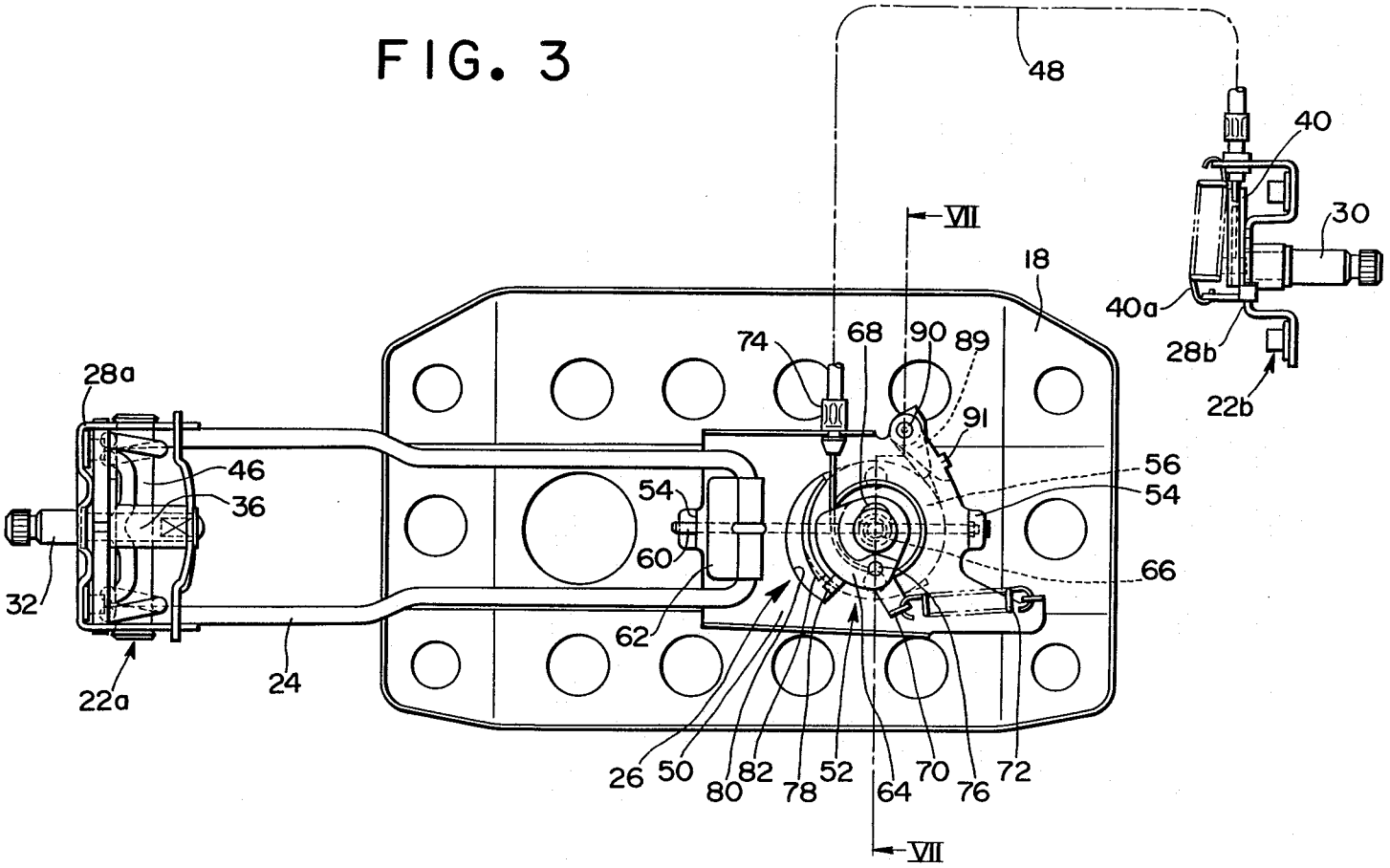
FIG. 3 is a plan view of the lumbar support of FIG. 2.
Figure 4:
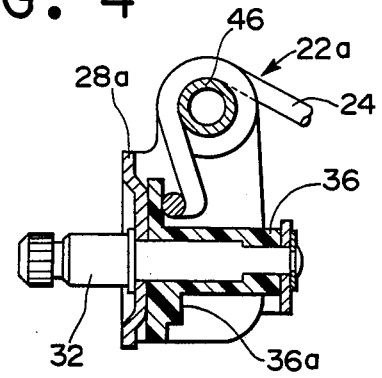
FIG. 4 is a partial sectional view of a bracket supporting a torsion spring.

Referring now to the first bracket 22*a* with reference to FIGS. 2–4, the first bracket 22*a* includes a casing 28*a* secured to the frame 20 and a first shaft 32 rotatably mounted on the casing 28*a* and the seatback 12 and extending therethrough. The left end portion of the shaft 32 is to be operatively connected to the lever 14 in FIG. 1 or FIG. 2.

The first bracket 22*a* further includes a cam member 36 secured to the outer periphery of the shaft 32 for integral rotation therewith. One end of the torsion spring 24 is curled around a pin 46 and is slidable on cam surface 36*a* of the cam member 36 when it is rotated. The other end of the torsion spring 24 is secured to the support plate 18 through support plate bracket assembly 26. When the lever 14 is rotated to rotate the cam member 36, the torsion spring 24 is actuated on the cam surface 36*a* to move the support plate 18 in forward and rearward direction.

Figure 8:
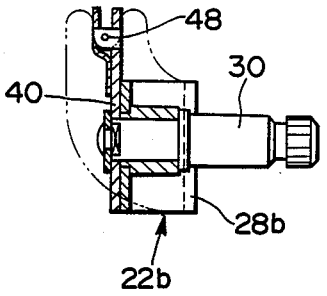
FIG. 8 is a partial sectional view of a bracket supporting the cable.

The second bracket 22*b*, as is shown in FIG. 3 and FIG. 8, includes a casing 28*b* secured to the second lateral side of frame 20, a second shaft 30 rotatably extending through the casing 28*b* and the other side of the lateral portion of the seatback 12. The right end of the shaft 30 is to be operatively connected to the lever 16 in FIG. 1. Adjusting plate 40 is secured to the shaft 30 for unitary rotation therewith. One end of the cable 48 is secured to the adjusting plate 40 and when the shaft 30 is rotated by lever 16 in one direction, the cable 48 is pulled in response to the rotational movement. Tension spring 40*a* is disposed between adjusting plate 40 and the casing 28*b* and is always biasing the shaft 30 in its returning direction.

The support plate bracket assembly 26 includes a support plate bracket 50 to which the other end of the torsion spring 24 is pivoted and a cam mechanism 52 mounted on the bracket 50. As viewed in FIG. 3, upper and lower flanges of the bracket 50 extend uprightly from the flat surface thereof. The bracket 50 further includes upwardly bent portions 54 at each side of the bracket 50. Cam mecahnism 52 includes a cam disc plate 56 disposed in a space between the support plate 18 and the support plate bracket 50. A hinge pin 60 is provided beneath the support plate 18 and extending through the two bent portions 54 (FIG. 3) so that the support plate 18 may be movable about the pin 60. The torsion spring 24 is pivoted to a curling plate 62 at its one end. Thus the bracket 50 and, therefore, the support plate 18 are movable back and forth with respect to the vehicle longitudinal direction, as the torsion spring 24 pivots about the pin 46 when the lever 14 is rotated to actuate the cam member 36. The cam mechanism 52 further includes a release plate 64 formed by two members welded together. The release plate 64 and the cam disc plate 56 are rotatably supported on pin 66 which extends through the bracket 50.

The release plate 64 has a sector shape as clearly shown in FIG. 3 and has an outwardly extending hook portion 70. A spring 72 is disposed between a hook of bracket 50 and the hook portion 70 of the release plate 64 and, therefore, the release plate 64 is always biased by the spring 72 in counterclockwise direction as viewed in FIG. 3.

One end of cable 48 is secured to the release plate 64 by pin 76. The cable 48 is guided through a holder 74 to the adjusting plate 40. The release plate 64 further includes a stopper 78 which is engaged with a pawl portion 82 provided on an outer peripheral surface of an elongated slot 80. The slot 80 is provided on the bracket 50.

When the lever 16 is rotated in one direction to pull the cable 48, the release plate 64 is rotated about pin 66 overcoming the biasing force of spring 72. This rotational movement of the plate 64 also causes the rotation of cam disc 56 in the same direction for caming action with the support plate 18. The cam disc 56 is rotatably by a right angle. When the rotation of the lever 16 is completed, the stopper 78 is slidably returned to its original position by the spring 72 to be engaged with the pawl portion 82 shown in FIG. 3.

Due to the caming action, it is necessary to make the hole 68 oval shape so that the stopper 78 may fully return to its original position.

A pawl 89 is pivotally attached to the bracket 50 by pin 90 and is always biased by leaf spring 91 toward cam disc 56 to be engaged with one of the pawls 82 provided on the outer periphery of the cam disc 56. The cam disc 56 has a cam surface 56*a* at one side surface. The cam surface 56*a* is a declined surface changing the thickness thereof.

The other side surface of the cam disc 56 is provided with projections 84 for reducing the contact area with the bracket 50 so as to minimize the friction force upon rotation.

An attachment plate 58 is secured to the support plate 18 at its rear end and is provided with projections 86*a*, 86*b* which are in contact with the cam surface 56*a*.

Figure 5:
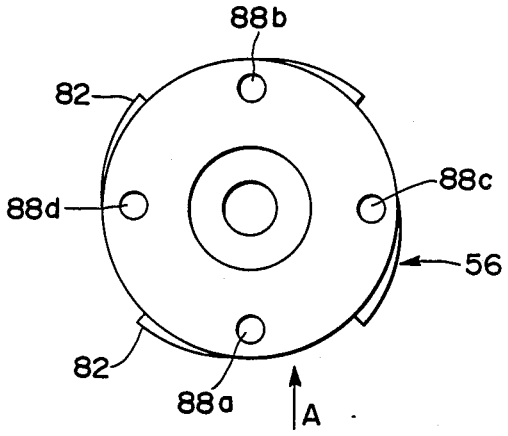
FIG. 5 is a view of the cam.
Figure 6:
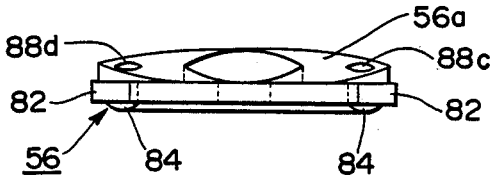
FIG. 6 is a view of the cam of FIG. 5 taken in the direction of arrow A in FIG. 5.
Figure 7:
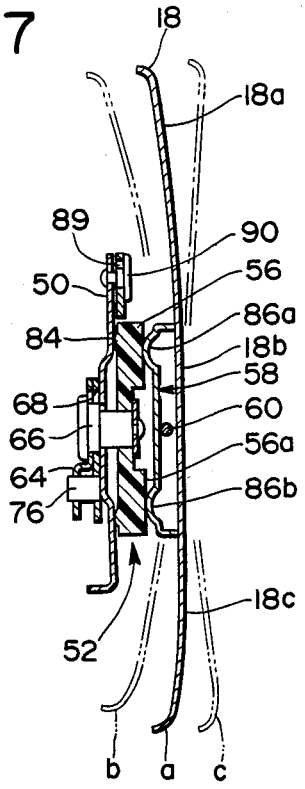
FIG. 7 is a sectional view taken along the line VII—VII of FIG. 3.

The cam surface 56*a* of cam disc 56 is provided with a plurality of recesses 88*a*, 88*b*, 88*c* and 88*d* which are to be in snap engagement with the projections 86*a* and 86*b* so as to keep the cam disc 56 at a predetermined position. The support plate 18 has an upper surface 18*a*, central surface 18*b* and a lower surface 18*c* as shown in FIG. 7. The projections 86*a* and 86*b* slidably movable on the cam surface 56*a* and the support plate 18 is movable about the pin 60 corresponding to the rotation of the cam disc 56. For example, when the recesses 88*d* and 88*c* are arranged vertically, the distance between the bracket 50 and the projection 86*a* of the attachment plate 58 is the same to that of the bracket 50 and the projection 86*b*. In this case, the support plate 18 keeps its position indicated as "a" in FIG. 7 and the contact with the seatback 12 is made at the central surface 18*b*. When the lever 16 is turned in a direction and the recess 88*b* of the cam surface 56*a* comes to the upper position as shown in FIG. 5, the distance between the projection 86*a* and the bracket 50 is greater than that of the projection 86*b* and the bracket 50. In this situation, the support plate 18 is shifted to "b" position and the contact with the seatback 12 changes to the upper surface 18*b*.

If the occupant wants to lower the lumbar support and rotates the lever 16 in the opposite direction, the projection 88*a* nears the bracket 50 closer than the projection 88*b* to shift the support plate 18 to the "c" position.

Thus the contact of the support plate 18 with the seatback 12 is adjustable by rotating lever 16 and vertical position of the lumbar support can be varied according to the heights of occupants of the seat.

It is obvious to make the adjusting stages more than three within the spirit of the invention.

What is claimed is:

1. A lumbar support for a backrest having a lumbar portion designed to be horizontally and vertically aligned with the lumbar region of a user of the backrest, said lumbar support being adjustable according to desired horizontal and vertical adjustment settings and comprising:

a. a support plate having front and rear surfaces, at least a portion of said front surface engaging the rear of said lumbar portion of said backrest to define an effective contact region, the horizontal position and vertical alignment of which varies with the vertical inclination and horizontal adjustment of said support plate;

b. first bracket means in fixed vertical position relative said backrest, said first bracket means pivotally supporting said support plate to permit changes in the vertical inclination of said support plate;

c. a cam member disposed between said support plate and said first bracket means and rotatably fixed to said first bracket means and rotatable in one direction to rotate said support plate to change the vertical inclination of said support plate, said cam member having a series of pawls circumferentially disposed about said cam member;

d. a frame supporting said backrest;

e. first control means for slidably positioning said support plate by an amount determined by the desired horizontal adjustment setting to align said effective contact region horizontally with the lumbar region of a user, said control means including a first casing fixed to said frame; a first shaft rotatably connected to said first casing; a coupler rotatable with said first shaft and having a cam surface; a torsion spring connected between said support plate and said first casing and slidably contacting said cam surface, wherein rotation of said cam surface varies the tension applied to said support plate by said torsion spring, f. second control means for rotating said cam member by an amount determined by the desired vertical adjustment setting, to align said effective contact region vertically with the lumbar region of a user, said control means including a second casing fixed to said frame, said first and second casings being affixed at substantially opposite sides of said backrest; a second shaft rotatably connected to said second casing; and transmission means for converting rotation of said second shaft into rotation of said cam member, said transmission means including:

an adjustment plate integrally attached to said second shaft;

a release plate for rotatably positioning said cam member;

cable means extending between said adjustment plate and said release plate for rotating said cam member in response to rotation of said adjustment plate in a first direction; and means for biasing said adjustment plate in a direction counter said first direction; and g. means for restricting rotation of said cam member in a direction counter said first direction including an extension pivotally mounted on said support plate and spring means for biasing said extension to engage corresponding ones of said series of pawls.

* * * * *